United States Patent [19]

Araya et al.

[11] 4,092,919

[45] June 6, 1978

[54] CARD SELECTING AND ADDRESS PRINTING APPARATUS

[75] Inventors: Kenzo Araya; Takashi Hashimoto, both of Tokyo, Japan

[73] Assignee: Tanaka Seiki Co., Ltd., Tokyo, Japan

[21] Appl. No.: 574,251

[22] Filed: May 5, 1975

[30] Foreign Application Priority Data

May 7, 1974 Japan ..... 49-50552

[51] Int. Cl.[2] ..... B41L 47/46

[52] U.S. Cl. ..... 101/53; 101/132.5; 271/4

[58] Field of Search ..... 101/47, 52, 53, 90, 101/91, 130, 131, 132, 132.5, 141, 142; 271/3, 4, 270

[56] References Cited

U.S. PATENT DOCUMENTS

| | | | |
|---|---|---|---|
| 2,965,019 | 12/1960 | Hayes et al. | 101/53 |
| 3,230,871 | 1/1966 | Kooch et al. | 101/53 |
| 3,401,627 | 9/1968 | Sheriff | 101/52 |
| 3,444,807 | 5/1969 | Kooch | 101/53 |
| 3,547,027 | 12/1970 | Gombault | 101/53 |
| 3,683,803 | 7/1970 | Gray et al. | 101/132 |
| 3,869,117 | 3/1975 | Yoshimura | 271/270 |

*Primary Examiner*—Ronald E. Suter
*Attorney, Agent, or Firm*—Oblon, Fisher, Spivak, McClelland & Maier

[57] ABSTRACT

A card selecting and address printing apparatus to select a card having specified information from among a group of cards bearing thereon coded information and a master printing address and to transfer-print the specified information from the card onto another sheet, having a card hopper for the group of cards including the card to be selected, a card feeder to feed the cards therefrom one at a time, an optical card reading and signal generating means for comparing the coded information on the card being fed with stored information and generating a signal, a card pass selecting mechanism for selecting one of two card paths according to the signal generated, a workpiece hopper and feeder for feeding paper one at a time from the workpiece hopper to a waiting station, holding it there and feeding it to a printing station in response to the signal generated, a printing means for transfering the master printing address on the selected card fed through the card pass selecting mechanism onto the paper fed from the workpiece feeder, a card stacker, and a card feeding roller for catching all of the cards fed through the apparatus and stacking them in the same order as they were held in the card hopper.

3 Claims, 1 Drawing Figure

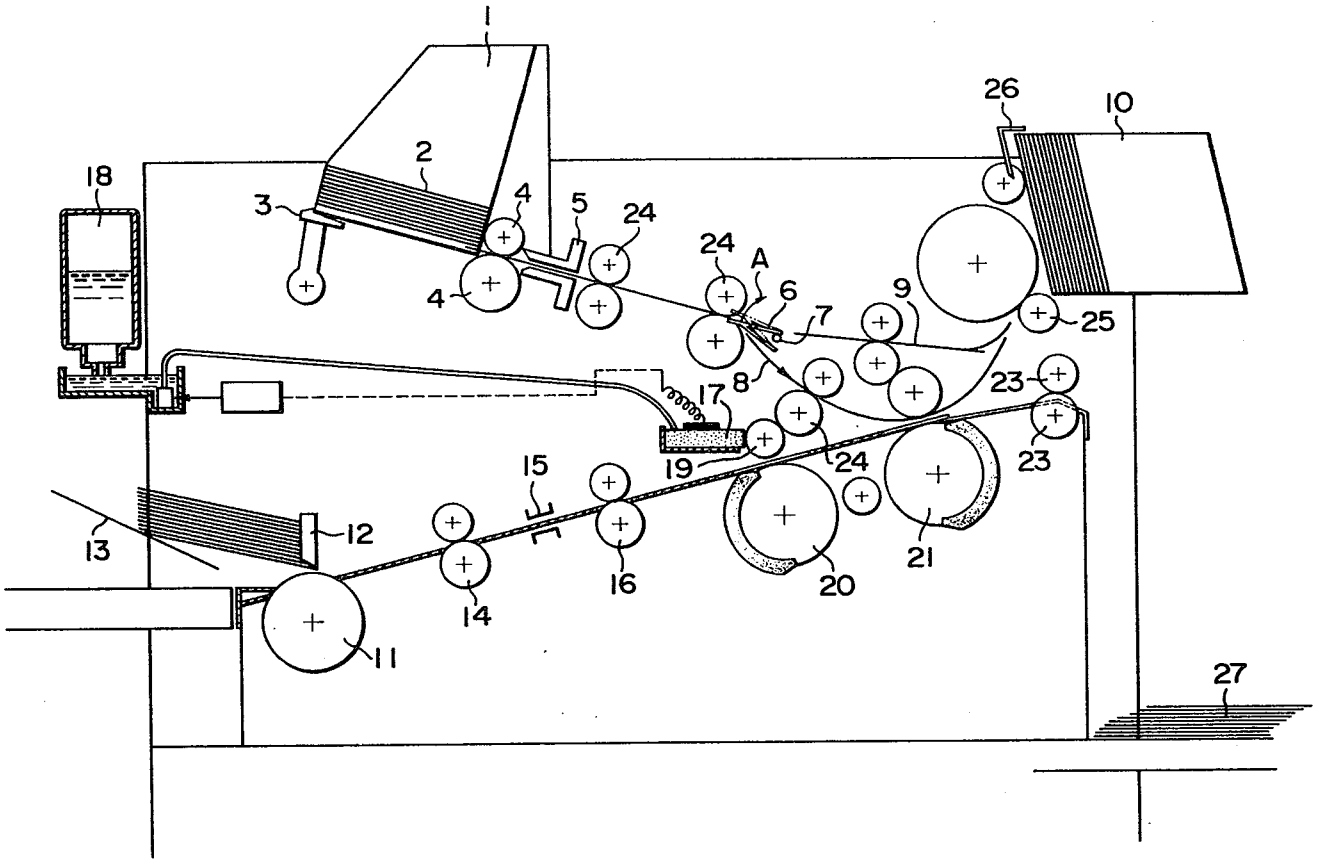
1
2
3
4
4
5
24
24
24
A
6
7
8
9
10
25
26
23
23
21
20
24
17
19
16
15
14
11
12
13
18
27

CARD SELECTING AND ADDRESS PRINTING APPARATUS

BACKGROUND OF THE INVENTION

1. Field of the Invention

This invention relates to a card selecting and address printing apparatus, and more particularly to an apparatus which selects a card with a specified information from a group of cards including thereon coded information and a master printing address, and transfer-prints the master printing address of the selected card onto another sheet, envelope or the like.

2. Description of the Prior Art

In a conventional address printer, it is general that cards including necessary master printing addresses are selected beforehand and the selected cards are introduced into a card hopper of the address printer. In order to avoid this much troublesome method, it has been proposed and worked out that the manual card selection is replaced with a card selector combined with the address printer, wherein the card selector selects beforehand desired cards and then these cards are introduced into the address printer as usual.

However, according to this combined system, the selected cards and the non-selected cards are separated by the card selector and they must be regularized again after printing operation through the card selector. Further, this system requires a separate card selector other than the ordinary address printer and therefore requires extra expense to the user in regard thereto.

SUMMARY OF THE INVENTION

Accordingly, a primary object of this invention is to provide an apparatus which performs both card selecting and address printing.

Another object of this invention is to provide a card selecting and address printing apparatus wherein the cards introduced thereto will be stacked in the provided order when its operation is over.

A card selecting and address printing apparatus according to this invention therefore includes a reading station to read photo-electrically coded marks on the cards fed from a card hopper. To this reading station a specified information, such as name and address or the like of a customer card, is storable, and a signal is generated by the reading station when the specified information is included in the code mark of the card. In response to the signal thus generated, the card is guided into the printing path. In the reverse case, the card is directed to the non-printing path. The card is then registered with the paper which has already been held at the waiting station on the paper feeding path and the master printing address borne on the card is transfer-printed onto the paper at its desired area. The card fed either through the printing path or through a non-printing path is stacked into a card stacker by means of a card feeding roller.

BRIEF DESCRIPTION OF THE DRAWINGS

These and other objects and features of the present invention and the details of operation and construction thereof are hereinafter more fully set forth and described with reference to the accompanying drawing, in which the sole FIGURE shows a preferred embodiment of the present invention.

DETAILED DESCRIPTION OF THE PREFERRED EMBODIMENT

In the FIGURE, a card hopper 1 contains cards 2 therein. Each card 2 bears a master printing address consisting of letters and numbers or the like and marks for selection which represent coded information. According to the shown embodiment of this invention, the letters of the master printing address are manuscript or may be typed with carbon paper, so as to obtain negative printing at the rear side of the card.

The coded information can include any kind of information, such as area code, sex, age or the like for the so-called customer cards, which are coded as marks on the cards.

At the underside of the card hopper 1 is swingably supported a card feeding pawl 3 which feeds cards from the card hopper 1 one at a time. By the swinging movement of the card feeding pawl 3, cards fed one at a time from the card hopper 1 will be fed thereafter to card feeding rollers 4,4 mounted at the outlet of the card hopper 1. The time interval for feeding cards by the card feeding pawl 3 and the feeding rollers 4,4 is set, considering the required printing time at the printing station, the length of the printing and non-printing paths, etc., so that the cards fed through the printing or non-printing paths can be received and subsequently stacked in a card stacker 10 in a predetermined manner or, more particularly or preferably, in the same order as maintained in the card hopper 1 among the cards selected for printing and those not selected at an inlet of a card stacker, the details of which will be explained later. The card feeding rollers 4,4 then feed the card to a conventional optical card reading and signal generating means 5, to which desired information for selecting necessary master printing cards is inputted and stored beforehand and which reads the coded information on the cards optically, compares the read information with the already stored information and generates a card selection signal if and when the card contains the necessary information corresponding to the stored information. In effect, when the cards are such as customer cards as mentioned above, the stored information of the optical card reading and signal generating stage 5 would be the particular customer area or age of customers. Taking the example of customer cards for customers in Japan, the specified area would be Tokyo, Osaka, Kyoto, etc., which may be specified with AND/OR information and the coded information may be stored in the stage 5. This optical card reading and signal generating stage 5 is adapted to be changed-over between a memory mode and a reading mode. Therefore if the stage 5 is on the memory mode, the stage 5 can memorize the specified data on the card into its memory through the feeding of the card. Accordingly, necessary information may at first be stored in this stage 5 by feeding one card with the required coded mark through this stage for storing. The stage may then be changed-over to the reading mode.

In case a card fed to the stage 5 is optically read thereby to include the same information as stored in the stage 5, such as the coded mark for "Tokyo", the stage 5 will generate a selection signal. If the card does not have such a mark, a non-selection signal will then be generated. The signal generated at this stage is transmitted, to the aforementioned card feeding pawl 3, a first paper feeding roller 11, second paper feeding rollers 14, third paper feeding rollers 16 to feed papers or workpieces to a printing station, printing rollers 20, 21, and a guiding member 6, as a control signal, these latter members being explained later. The system consisting of these elements are controlled sequentially with the signal from the stage 5. Rollers 24,24 are provided to further advance cards from the optical card reading and signal generating stage 5, the outlet of which is provided with a path selecting mechanism. The path selecting mechanism includes the Y-shaped guiding lever 6 and an axle 7 to which the guiding lever 6 is fixed. The axle 7 is adapted to be able to rotate in the direction of arrow A in response to the signal. Namely, when the signal from the optical card reading the signal generating means 5 is applied to this path selecting mechanism, the axle 7 moves in the direction of the arrow A and forces the Y-shaped member 6 to move into the position shown in the dotted line in the drawing so as to keep the position for a constant short time interval. While the Y-shaped member 6 is in the dotted line position, the card is directed to a printing path 8. On the other hand, while it is in the solid line position, the card is directed to another path 9. The card directed to the printing path 8 will be hereinafter referred to as a selected card, while the card directed into the path 9 will be referred to as a non-selected card.

When the stage 5 reads the non-selected card, or when the card read at the stage 5 does not contain the specified information, the signal generated at the stage 5 is transmitted only to the card feeding pawl 3 and the card feeding rollers 4,4, whereby the pawl 3 and the rollers 4,4 feed the next card 2 with the predetermined time interval of the non-selected mode, which is sufficiently shorter than that of the selected mode to be explained later. While the non-selected mode repeats, the Y-shaped lever 6 keeps its solid line position, as mentioned above, where the cards are fed through the upper side of the lever 6 and through the non-printing path 9 into a roller 25, which then stacks the cards into a card stacker 10.

Papers or workpieces on which the master printing address is to be transfer-printed from the cards 2, such as mailing envelopes, are supported by a slightly downwardly inclined paper holding pedestal 13, a workpiece hopper 12 whose lower end constitutes an outlet for the workpieces and the first paper feeding roller 11. The circumferential velocity of the first paper feeding roller 11 is adapted to be slower than that of the other rollers 14 included in the system and a slipping mechanism is provided between the first paper feeding roller 11 and its driving axle. When a paper or workpiece is fed one at a time from the first paper feeding roller 11 to a set of rollers or the second paper feeding rollers 14, the paper is drawn with the higher circumferential velocity of the rollers 14, thereby synchronizing the circumferential velocity of the roller 11 with that of the rollers 14 by means of the slipping mechanism provided in connection with the roller 11, until the rear end of the paper or workpiece disengages from the first paper feeding roller 11. The roller 11 then recovers its lower circumferential velocity, and again begins to draw the next paper from the hopper 12. It will therefore be seen that the papers are fed one by one, with a constant distance corresponding to the difference between the circumferential velocity of the roller 11 and the rollers 14. Along the paper feeding path there is provided next to the second paper feeding rollers 14 a conventional paper position sensing and timing device 15 which photo-electrically senses the leading end of the paper.

After the sensing device 15 senses the leading end of the paper, the timer thereof starts to work and generates a signal after a constant time interval to stop rotation of the paper feeding rollers 11, 14 and 16. As the result, a paper is stopped at a constant distance corresponding to the time interval defined by the timer, and held at this waiting station. The time interval defined by the timer is variably set by means of a printing position setting dial, not shown. The rollers 11, 14 and 16 are adapted to start rotation in response to the signal from the stage 5 and advance the next paper accordingly, also advancing the paper being held at the waiting station to the paper station. On the other hand, the sensing device 15 transmits a card feeding signal to the card feeder system 3 and 4 after sensing the leading end of the paper from the paper feeding path defined by the rollers 11 and 14. The card feeder may then feed the next card for reading at the stage 5.

The roller 20 is provided for facilitating the application of a solvent onto the paper and the roller 21 of similar form is provided for pressing together the master printing address of the card fed into the printing path and the paper from the paper feeding path and for transfer-printing the master address onto the paper. Around the peripheries of the rollers 20 and 21 are mounted respectively segmental elastic pads such as sponge rubber. The interconnection and the operation of the rollers 20 and 21 are well known in this field of art, and therefore a detailed explanation thereof will not be made. To a roller 19 facing the roller 20 is contacted an absorbent member 17 to which solvent, such as alcohol, is applied through a small conduit from a solvent tank 18 by a pump. Deviation of the wetting rate of the absorbent member 17, such as a felt or the like, to be wetted by the solvent is detected as a capacitance deviation of a capacitor in which the felt is used as a dielectric, and the detected result is applied to a solvent pump driving circuit so as to keep the wetting rate at a constant value, and the solvent pump is operated to maintain this capacitance at a predetermined level. Accordingly, the wetting rate of the absorbent member 17 is maintained constant irrespective of the number of papers to be printed or the time interval for printing.

Rollers 23,23 are provided for taking up the papers or workpieces after the master printing address is transfer-printed thereon, whereby the finished papers are brought to the position shown at 27.

A roller 25 provided at the inlet of the card stacker 10 is for stacking the non-selected cards fed through the path 9 and the selected cards fed through the printing path 8, and a member 26 is an upper end limiting member for these cards received.

The operation of the apparatus thus explained above is as follows:

At first, specified information for selecting the desired cards is stored into the optical card reading and signal generating stage 5, which can be achieved by passing any card containing a coded mark representing the desired specified information through the stage 5 which is changed over at such time into the memory mode. Then a group of cards including cards to be selected are accommodated into the card hopper 1, to finish the preparation stage of operation. A ready switch, not shown, is then turned on, to place the apparatus into operation. In response to the turning-on of the ready switch, the lowermost paper or workpiece of the papers on the paper feeding pedestal 13 is drawn out of the outlet of the workpiece hopper 12 by the first paper feeding roller 11. When the paper reaches the second paper feeding rollers 14, it is advanced with the circumferential velocity of the rollers 14. The rollers 14 continue to advance the paper to the paper sensing station 15 at which the required paper stopping position is set beforehand by means of a printing position setting dial. Therefore, when the leading end of the paper or workpiece reaches the paper sensing station 15, the timer thereof starts and after a constant time interval stops the operation of the first paper feeding roller 11, the second paper feeding rollers 14 and third paper feeding rollers 16. At this stage, the paper stops its advancement and waits there at the waiting station. This waiting position is therefore the position set by the printing position setting dial. It will be seen that by varying the setting value of the printing position setting dial, the printing area desirable on the paper or workpiece may to freely be chosen. Thus, by virtue of this system, registration of the master printing address on the selected address card fed through the printing path 8 with the printing area on the paper or workpiece may be made precisely at the printing station. When the rear end of the paper or workpiece passes from the first paper feeding roller 11, the next paper or workpiece is at once fed from the workpiece hopper 12 and by the first paper feeding roller 11 and the same again stops at the set position as mentioned above. While the paper is held at this waiting station, a start switch, not shown, is depressed, so that the card feeding pawl 3 pushes a lowermost card from the accommodated cards 2 and advances it to the card feeding rollers 4,4, which in turn feed the card 2 to the optical card reading and signal generating stage 5. At this stage 5, the coded information on the card 2 is optically read as it passes the stage, is compared with the already stored information, and it is determined whether the card is to be selected or non-selected. If the card 2 is to be non-selected, the card is fed along the upper path of the guiding lever 6 and advances into the non-printing path 9 up to the card stacker 10. The reading stage 5, when it has read the card to be non-selected, transmits an order signal to the card feeding pawl 3 to take out the next card 2. In the case when a non-selected card is read, the spacing between the rear end of the preceding card and the leading end of the succeeding card is kept very small, so that the cards are rapidly fed.

If the card is one to be selected, the reading stage 5 transmits a signal to the directing means so as to rotate the Y-shaped member 6 in the direction of arrow A around the axle 7, which then guides the card into the printing path 8. On the other hand, the reading stage 5 transmits, when the card to be selected has passed, a signal after a constant time interval to the first paper feeding roller 11, the second paper feeding rollers 14 and the third paper feeding rollers 16 so as to start the rotation of these rollers. More particularly, the selected card advances below the guiding lever 6 into the printing path 8, while the paper or workpiece is fed through the rollers 16 to the roller 20. There, the printing area on the paper or workpiece is wetted, being pressed between the segmental elastic pad and the solvent applying roller 19. The paper is further advanced to the printing press roller 21 and there the master printing address of the selected card and the wetted area on the paper or workpiece are registered and the registered card and paper are pressed by the pressing pad of the roller 21 so as to obtain the desired transfer-printing. After such transfer-printing, the card and paper or workpiece on which an address corresponding to the master printing address is made are separated from each other. The finished paper will be guided through the fourth paper feeding rollers 23, 23 and advanced to the position shown as 27. On the other hand, the card with the master printing address advances along the remaining part of the printing path and is stacked into the card stacker as in the case of non-selected cards.

The invention has been described in detail with particular reference to a preferred embodiment thereof, but it will be understood that variations and modifications can be effected within the spirit and scope of the invention.

What is claimed is:

1. A card selecting and address printing apparatus for selecting a card having specified information from among a group of cards bearing thereon coded information and for transfer-printing said specified information from said card onto a sheet of paper comprising:

a card hopper to receive therein a group of cards including the cards to be selected and those not to be selected;

a card feeder for feeding the cards, from the card hopper, one at a time at a predetermined time interval;

an optical card reading and signal generating means, stored with specified information, which reads the coded information on a card fed by the card feeder, compares it with the stored specified information, and generates a first signal accordingly which will render said card either a selected or a non-selected card depending upon whether or not said card has information thereon which corresponds to the specified information of said optical means and which generates a second signal for actuating said card feeder at a shorter time interval than said predetermined time interval for feeding a subsequent card when said read card is a non-selected card, to ensure rapid feeding of the cards in such cases;

a card path selecting mechanism which selects a card path according to said first signal generated at the optical card reading and signal generating means so as to transport said selected card along a printing path or said non-selecting card along a non-printing path, respectively;

a workpiece hopper accommodating therein papers on which said specified information is to be transfer-printed;

a workpiece feeder for feeding said papers one at a time successively along a paper feeding path from the workpiece hopper to a waiting station provided adjacent to a printing station of the paper and for subsequently feeding the paper to the printing station in response to the third signal generated from the optical card reading and signal generating means when said read card is a selected card while simultaneously feeding the next paper to the waiting station;

said workpiece feeder including first and second paper feeding rollers along said paper feeding path, the first roller being mounted under the work piece hopper, the second roller being disposed at a distance from the first roller which is less than or equal to the length of said paper, and the circumferential velocity of the second roller being higher than that of the first roller, so as to maintain an appropriate distance between the papers fed along the paper feeding path;

a paper position sensing and timing device for generating a fourth signal for stopping said workpiece feeder in order to stop the workpiece at said waiting station at a preselected constant time interval after said paper is sensed by said paper position sensing and timing device;

printing means disposed at said printing station which pressedly transfer-prints said specified information on the selected card fed through the card path selecting mechanism and the printing path onto the paper fed from the workpiece feeder along said paper feeding path;

a card stacker; and a card stacking roller which catches the cards fed through the printing path and through said non-printing path and stacks them in the card stacker in the same order as they were held in the card hopper.

2. A card selecting and address printing apparatus for selecting a card having specified information from among a group of cards bearing thereon coded information and for transfer-printing said specified information from said card onto a sheet of paper comprising:

a card hopper to receive therein a group of cards including the cards to be selected and those not to be selected;

a card feeder for feeding the cards, from the card hopper, one at a time at a predetermined time interval;

an optical card reading and signal generating means, stored with specified information, which reads the coded information on a card fed by the card feeder, compares it with the stored specified information, and generates a first signal accordingly which will render said card either a selected or a non-selected card depending upon whether or not said card has information thereon which corresponds to the specified information of said optical means and which generates a second signal for actuating said card feeder at a shorter time interval than said predetermined time interval for feeding a subsequent card when said read card is a non-selected card, to ensure rapid feeding of the cards in such cases;

a card path selecting mechanism which selects a card path according to said first signal generated at the optical card reading and signal generating means so as to transport said selected card along a printing path or said non-selected card along a non-printing path, respectively;

a workpiece hopper accommodating therein papers on which said specified information is to be transfer-printed;

a workpiece feeder for feeding said papers one at a time successively along a paper feeding path from the workpiece hopper to a waiting station provided adjacent to a printing station of the paper and for subsequently feeding the paper to the printing station in response to a third signal generated from the optical card reading and signal generating means when said read card is a selected card while simultaneously feeding the next paper to the waiting station;

a paper position sensing and timing device for generating a fourth signal for stopping said workpiece feeder in order to stop the workpiece at said waiting station at a preselected constant time interval after said paper is sensed by said paper position sensing and timing device;

printing means disposed at said printing station which pressedly transfer-prints said specified information on the selected card fed through the card path selecting mechanism and the printing path onto the paper fed from the workpiece feeder along said paper feeding path, said printing means comprising a wetting mechanism for wetting a predetermined area on the paper on which the transfer-printing is to be made, and a pressing mechanism for pressing said card and paper together so as to transfer-print said specified information from the selected card onto the predetermined area of the paper;

a card stacker; and a card stacking roller which catches the cards fed through the printing path and through said non-printing path and stacks them in the card stacker in the same order as they were held in the card hopper.

3. A card selecting and address printing apparatus according to claim 2 wherein the wetting mechanism includes a roller continually contacted by an absorbent member.

* * * * *